United States Patent [19]

Strom

[11] Patent Number: 4,885,858

[45] Date of Patent: Dec. 12, 1989

[54] INFLATABLE PLASTIC STRUCTURE SIMULATING A BEVERAGE CAN OR BOTTLE WITH CAPPED END

[75] Inventor: David H. Strom, Chicago, Ill.

[73] Assignee: Strom International, Ltd., Chicago, Ill.

[21] Appl. No.: 154,375

[22] Filed: Feb. 10, 1988

[51] Int. Cl.[4] ..... G09F 1/08

[52] U.S. Cl. ..... 40/538; 40/212; 40/214

[58] Field of Search ..... 40/212, 214, 538, 584, 40/215

[56] References Cited

U.S. PATENT DOCUMENTS

| | | | |
|---|---|---|---|
| 1,924,236 | 8/1933 | Friedberg | 40/212 |
| 3,180,639 | 4/1965 | Cotler et al. | 40/538 |
| 4,369,591 | 1/1983 | Vicino | 40/214 |
| 4,447,974 | 5/1984 | Vicino | 40/212 |

FOREIGN PATENT DOCUMENTS

| | | | |
|---|---|---|---|
| 576954 | 5/1958 | Italy | 40/214 |

*Primary Examiner*—Kenneth J. Dorner
*Assistant Examiner*—Wenceslao J. Contreras
*Attorney, Agent, or Firm*—Myron C. Cass

[57] ABSTRACT

An inflatable plastic structure simulating a beverage can or bottle with a capped end. The upper end of the structure is provided with an annular lip projecting vertically from the peripheral edge thereof. The lip is adapted to be folded down over the end of the structure, and may be provided with a tubular ring inflatable separately from the structure to resemble the rim of a beverage can.

18 Claims, 1 Drawing Sheet

FIG. 1
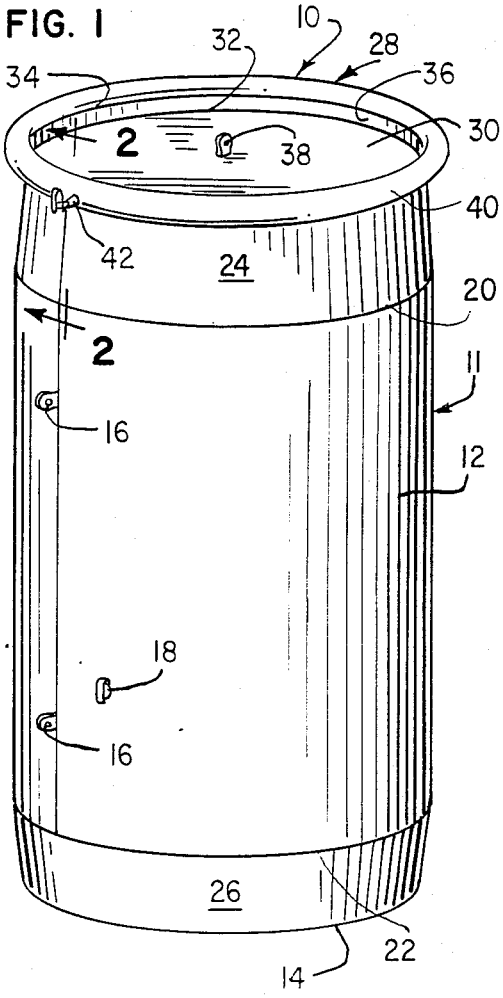
FIG. 2
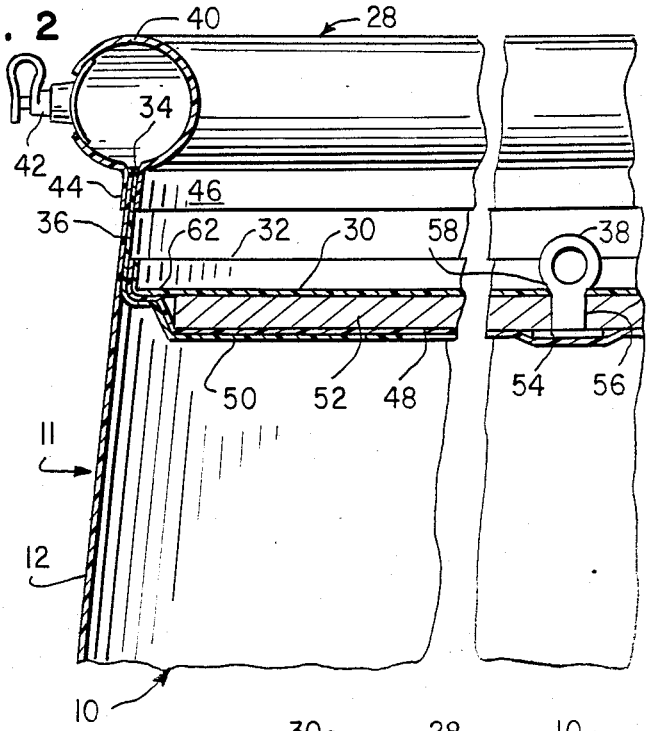
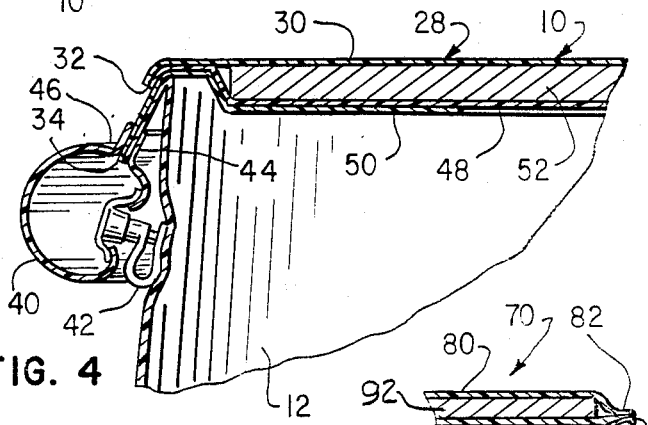
FIG. 4
FIG. 3
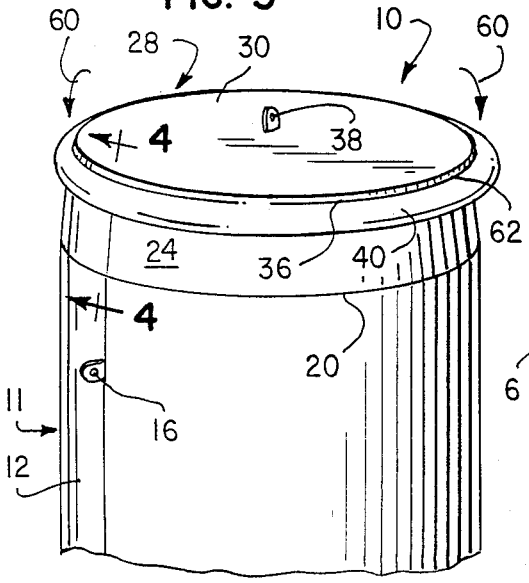
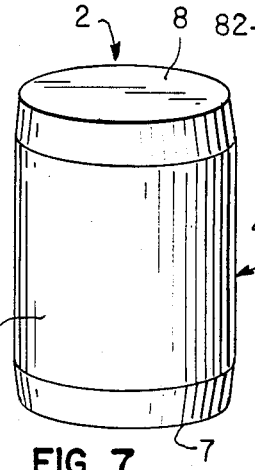
FIG. 7
Prior Art
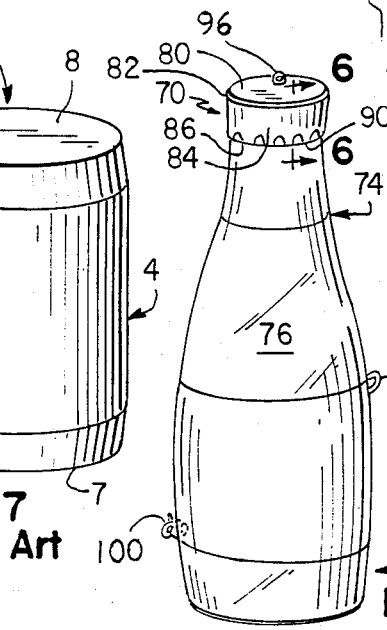
FIG. 5
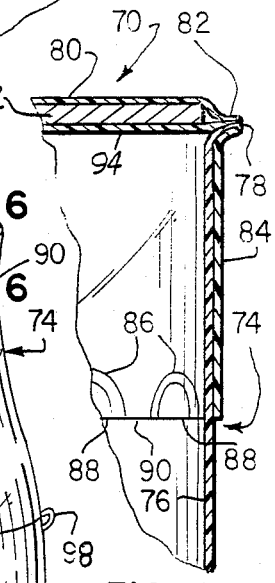
FIG. 6

INFLATABLE PLASTIC STRUCTURE SIMULATING A BEVERAGE CAN OR BOTTLE WITH CAPPED END

The invention relates generally to inflatable plastic structures simulating beverage cans or bottles and more particularly, to such a structure provided with formations simulating the capped ends of such beverage containers.

BACKGROUND OF THE INVENTION

Inflatable plastic structures designed to simulate beverage cans or bottles are often used by beverage manufacturers, distributors and retailers in promotional activities relating to particular beverages. The structures are made of flexible plastic and are collapsible when not inflated. Usually, at least one valve is provided for inflating the structure, and stiffening plates are secured to the upper and lower ends to provide stability, to maintain a realistic shape and to provide support for eyelets used to secure the structures to signs, buildings vehicles etc. Often the structures are several times larger than life size. The exterior of the structure is colored and decorated to simulate the contents, label and decoration of the actual beverage can or bottle.

A simulative deficiency in prior inflatable bottle and can structures has been that the upper ends are not relatistic simulations of beverage can tops or bottle caps in that the configuration features of the actual containers have not been simulated in the inflatable. These features include the upper annular lip or rim of conventional beverage cans, and the cap of a conventional glass beverage bottle which include special contoured configurations leading from the container body to the capped end.

It is advantageous for promotional purposes to provide an inflatable plastic structure which simulates a beverage can or bottle and has the special contours which simulate the capped ends of such containers more realistically.

SUMMARY OF THE INVENTION

An inflatable plastic structure simulating a beverage can or bottle with a capped end. The structure includes a substantially cylindrical flexible plastic body having an annular wall. An end formation is sealingly secured to the upper end of the annular wall which is constructed to form an annular lip at the junction of the end formation and the annular wall. The lip is adapted to be folded down over the upper end of the structure to simulate the special contoured configuration at the cap end of an actual beverage container. The lip may be provided with a tubular ring located at its outer peripheral edge, the ring adapted to be inflated independently of the structure to resemble the capped rim of a beverage can. A rigid plate may also be provided to maintain the planar shape of the upper end of the strucure, and score lines may be provided on the upper end portion and/or the lip as desired to simulate structural features of actual beverage cans or bottles.

BRIEF DESCRIPTION OF THE DRAWINGS

FIG. 1 is a perspective view of the inflatable structure embodying the invention inflated in the form of a beer or other beverage can.

FIG. 2 is a fragmentary sectional view taken along the line 2—2 of FIG. 1 in the direction indicated generally;

FIG. 3 is a fragmentary perspective view of a modified form of the inflatable of FIG. 1;

FIG. 4 is a fragmentary sectional view taken along the line 4—4 in FIG. 3 and in the direction indicated generally;

FIG. 5 is a perspective view of an alternate embodiment of the invention designed to simulate a bottle cap;

FIG. 6 is a fragmentary sectional view taken along the line 6—6 in FIG. 5 and in the direction indicated generally;

FIG. 7 is a perspective view of a prior art inflatable structure simulating a beverage can.

DESCRIPTION OF THE PREFERRED EMBODIMENT

Referring to FIG. 7, a prior art inflatable plastic simulated beverage container structure is indicated generally by the reference numeral 2. The structure 2 has a body 4, an annular wall 6, a bottom end 7 and a top sheet 8. The top sheet 8 is sealingly secured to the annular wall 6 along their respective edge margins (not shown), which are located on the interior of the body 4 for aesthetic purposes. It will be readily observed that the flat topped appearance of the structure 2 lacks the structural detail in the cap area and is an inferior simulation of an actual container, especially in comparison to the structure of the invention disclosed in FIGS. 1–6 and described hereinbelow.

Referring to FIG. 1, an inflatable structure embodying the invention is designated generally by reference numeral 10. The structure 10 is shown inflated to include a cylindrical body 11 fabricated of flexible plastic material capable of being inflated by means of a gaseous material. The body 11 includes an annular wall 12, a bottom wall portion 14 sealingly secured thereto, at least one eyelet 16 and a valve 18 for the introduction of gas such as air into the boyd 11 to effect inflation. The wall 12 may be provided with annular seams 20, 22 which define slightly tapered upper and lower portions 24, 26 to more accurately simulate actual containers. In FIG. 1, the body 11 is configured as a beverage can, although configuration as a bottle or other conventional beverage container is contemplated.

The body 11 is provided with an upper end portion 28 including an upper flexible plastic sheet 30 which is secured at its outer peripheral margin 32 to the upper end of the wall 12 so as to form an annular lip 36 shown projecting vertically from the body 11. The lip 36 may either be integral with the sheet 30 or an extension of the wall 12, depending upon the manufacturing methods used. In FIGS. 1 and 2, the sheet 30 is shown recessed from the upper edge 34 of the wall 12 to form the lip 36. The sheet 30 may also be provided with an eyelet 38.

A tubular ring 40 is shown secured to the upper edge 34 which, in the preferred embodiment, is the upper edge of the lip 36. The ring 40 is inflatable separately from the body 11, and accordingly, is provided with a separate valve 42. The valve 42 preferably is located on the outer peripheral edge of the ring 40 for cosmetic reasons described in more detail in connection with FIG. 4. The ring 40 is constructed and arranged to resemble the upper lip or rim of a conventional metallic beverage can.

Referring to FIG. 2, the upper end portion 28 of the inflatable structure 10 is shown in greater detail. The two edge margins 44, 46 of the tubular ring 40 straddle and are sealingly attached to the upper edge 34. The outer margin 32 of the sheet 30 is shown sealingly attached to a support sheet 48, which in turn is attached wither to the wall 12 or to a supplemental support sheet 50. The support sheet 48 and the sheet 30 are adapted to sandwich a stiffening plate 52 of cardboard or similar material therebetween to give structural support to the structure 10 and to provide a more realistic appearance thereof. The plate 52 is substantially codimensional with the sheet 30. A further function of the plate 52 is to provide support for the eyelet 38. The eyelet 38 is inserted through a bore 56 in the plate 52 and then through an aperture 58 in the sheet 30. The eyelet 38 is sealingly isolated from the interior of the structure 10 by the support sheet 48.

Referring to FIG. 3, once the body 11 and the ring 40 are inflated, the lip 36 is folded down over the wall 12 in the direction indicated by the arrows 60 to simulate the lid of an actual beverage can. If desired, a score line 62 may be provided at the base of the lip 36 or on other areas of the body 11 to create a more realistic appearance. FIG. 4 illustrates that once the ring 40 is in the folded condition, the valve 42 is concealed behind the lip 36 and is held against the wall 12.

Referring to FIG. 5, an alternate embodiment of the invention is indicated generally by the reference numeral 70. The structure 70 is shown inflated to include a substantially cylindrical body 72 with a tapered upper neck portion 74 designed to resemble a beverage bottle. The body 72 further includes an annular wall 76 having an upper edge margin 78. In similar fashion to the embodiment illustrated in FIGS. 1–4, a top or cap sheet 80 is sealingly secured at its outer peripheral margin 82 to the upper edge margin 78 of the wall 76 so as to form an annular lip 84. The lip 84 essentially differs in construction from the lip 36 in not having a tubular ring 40. The lip 84 is adapted to fold over the upper end of the neck portion 74 to simulate the outer rim of an actual beverage bottle cap. Accordingly, suitable decorations, such as embossed 'U'-shaped formations 86 are provided thereon on the outer edge margin designed to resemble the crimped radial projections of an actual cap. The formations 86 are located on the lip 84 so that the open ends 88 thereof are adjacent the outer edge margin 90 of the lip 84.

Once the lip 84 is folded over the end of the neck 74, it creates a more realistic three-dimensioned effect in the structure 70 not found on prior art simulated beverage bottles, in which the cap details were merely painted or printed thereon.

Referring to FIG. 6, the structure of the upper area of the neck 74 is illustrated in greater detail. In similar fashion to the embodiment depicted in FIGS. 1–4, the structure 70 has a stiffening plate 92 sandwiched between the cap sheet 80 and a support sheet 94. The support sheet 94 is sealingly attached to the cap sheet 80 at the respective outer edge margins thereof.

Referring to FIGS. 5 and 6, the structure 70 may be provided with an upper eyelet 96, at least one side eyelet 98 and a suitable valve 100 in similar fashion to the embodiment illustrated in FIGS. 1–4.

While a preferred embodiment of the invention has been shown, it will be understood that the invention may be otherwise embodied within the scope of the appended claims. Minor variations in the structure and in the arrangement and size of the various parts may occur to those skilled in the art without departing from the spirit and scope of the invention.

I claim:

1. An inflatable structure simulating a beverage can or bottle with a capped end comprising:
   a tubular flexible body having an annular wall and a bottom end portion sealingly secured thereto; and
   an upper end portion sealingly secured to an upper end of said wall to form an annular lip projecting vertically from said body, said lip adapted to be folded over said end of said wall to resemble a capped end of a beverage can or bottle, said lip being provided with a flexible tubular ring sealingly secured to an outer edge margin thereof and adapted to be inflated separately from said body.

2. The structure defined in claim 1 wherein said upper end portion is provided with internal stiffening means.

3. The structure defined in claim 1 wherein said end portion is located slightly recessed from the peripheral edge margin of said annular wall so that said lip is formed from said upper end of said wall.

4. The structure defined in claim 1 wherein said ring is provided with a valve located on an outer peripheral edge thereof so that when said lip is folded, said valve is concealed.

5. The structure defined in claim 1 wherein said lip is defined by an annular score line at a base thereof.

6. The structure defined in claim 1 wherein said upper end portion is provided with at least one eyelet.

7. The structure defined in claim 1 wherein said annular wall is provided with at least one eyelet.

8. The structure defined in claim 1 wherein said lip is provided with a plurality of formations designed to simulate the crimped radial projections of an actual beverage bottle cap.

9. The structure defined in claim 8 wherein said formations are U-shaped and are located on an outer edge margin of said lip.

10. An inflatable plastic structure simulating a beverage can or bottle with a capped end comprising:
   a substantially cylindrical flexible body having an annular wall and a bottom end portion sealingly secured thereto;
   an upper end portion sealingly secured to an upper end of said annular wall and located thereon recessed from a peripheral edge margin thereof so that said edge margin forms an annular lip, said lip adapted to be folded down over said annular wall;
   a flexible tubular ring sealingly secured to said peripheral edge margin and adapted to be inflated separately from said body to resemble an upper rim of a beverage can or bottle; and
   an internal stiffening plate sealingly sandwiched between said upper end portion and at least one supplemental sheet of flexible material.

11. The structure defined in claim 10 wherein said ring is provided with a valve located on an outer peripheral edge thereof so that when said lip is folded, said valve is concealed.

12. An inflatable structure simulating a beverage can or bottlle with a capped end comprising:
   a tubular flexible body having an annular wall and a bottom end portion sealingly secured thereto; and
   an upper end portion sealingly secured to an upper end of said wall to form an annular lip projecting vertically from said body, said lip adapted to be folded over said end of said wall to resemble a capped end of a beverage can or bottle, said upper end portion being provided with internal stiffening means, said stiffening means including a rigid insert plate substantially codimensional with said upper end portion and located on an underside thereof.

13. The structure defined in claim 12 wherein said insert is sealingly sandwiched between said upper end portion and at least one supplemental sheet of flexible material.

14. An inflatable structure simulating a beverage can or bottle with a capped end comprising:

a tubular flexible body having an annular wall and a bottom end portion sealingly secured thereto; and an upper end portion sealingly secured to an upper end of said wall to form an annular lip projecting from said body, said lip folded over said end of said wall to resemble a capped end of a beverage can or bottle, said upper end portion including a top sheet and support sheet codimensional one with the other and secured together along edges thereof to form a pocket therebetween extending substantially across said upper end, and stiffening means installed in said pocket and extending substantially the length of the pocket.

15. The structure defined in claim 14 wherein said stiffening means comprises a rigid insert plate substantially codimensional with said upper end portion.

16. The structure defined in claim 14 wherein said lip is defined by an annular score line at a base thereof.

17. The structure defined in claim 16 wherein said lip is provided with a plurality of formations designed to simulate the crimped radial projections of an actual beverage bottle cap.

18. The structure defined in claim 17 wherein said formations are U-shaped and are located on an outer edge margin of said lip.

* * * * *

UNITED STATES PATENT AND TRADEMARK OFFICE

CERTIFICATE OF CORRECTION

PATENT NO. : 4,885,858

DATED : December 12, 1989

INVENTOR(S) : David H. Strom

It is certified that error appears in the above-identified patent and that said Letters Patent is hereby corrected as shown below:

Column 3, line 7, delete "wither" and insert --either--;

Column 3, line 14, insert --The eyelet 38 has a base flange 54 which interfaces with the plate 52 to retain the eyelet 38 within the structure 10 when the structure is suspended from the eyelet 38.--; and Column 4, line 62, delete "bottlle" and insert -- bottle--.

Signed and Sealed this

Twenty-third Day of October, 1990

*Attest:*

HARRY F. MANBECK, JR.

*Attesting Officer*

*Commissioner of Patents and Trademarks*